US009050544B2

(12) United States Patent
Chen

(10) Patent No.: US 9,050,544 B2
(45) Date of Patent: Jun. 9, 2015

(54) WATER AND BUBBLE TOY

(71) Applicant: Bo Chen, Shantou (CN)

(72) Inventor: Bo Chen, Shantou (CN)

( * ) Notice: Subject to any disclaimer, the term of this patent is extended or adjusted under 35 U.S.C. 154(b) by 175 days.

(21) Appl. No.: 13/835,733

(22) Filed: Mar. 15, 2013

(65) Prior Publication Data

US 2014/0273708 A1 Sep. 18, 2014

(51) Int. Cl.
*A63H 33/28* (2006.01)

(52) U.S. Cl.
CPC ..... *A63H 33/28* (2013.01)

(58) Field of Classification Search
USPC ..... 446/15, 16, 21, 176, 178, 473, 475, 483
See application file for complete search history.

(56) References Cited

U.S. PATENT DOCUMENTS

| | | | | | |
|---|---|---|---|---|---|
| 2,974,438 | A | * | 3/1961 | Hopkins | 446/16 |
| 3,399,485 | A | | 9/1968 | Cashavelly et al. | |
| 4,334,383 | A | | 6/1982 | Melotti | |
| 5,074,437 | A | | 12/1991 | D'Andrade et al. | |
| D331,609 | S | | 12/1992 | LaFata | |
| 5,234,129 | A | | 8/1993 | Lau | |
| 5,366,402 | A | * | 11/1994 | Rudell et al. | 446/16 |
| 5,462,469 | A | * | 10/1995 | Lei | 446/15 |
| 5,613,890 | A | | 3/1997 | DeMars | |
| 5,730,325 | A | | 3/1998 | Cheung | |
| 5,746,636 | A | * | 5/1998 | Cernansky et al. | 446/16 |
| 5,842,899 | A | * | 12/1998 | Cernansky et al. | 446/16 |
| 5,975,358 | A | | 11/1999 | Zheng et al. | |
| 6,416,377 | B1 | * | 7/2002 | Bart | 446/15 |
| 6,544,091 | B1 | * | 4/2003 | Thai | 446/15 |
| 6,682,570 | B2 | | 1/2004 | Thai | |
| 6,969,293 | B2 | | 11/2005 | Thai | |
| D514,173 | S | | 1/2006 | McBride et al. | |
| 7,059,930 | B2 | * | 6/2006 | Choi | 446/15 |
| 7,172,485 | B2 | | 2/2007 | Thai | |
| 7,731,064 | B2 | | 6/2010 | Chuang et al. | |
| 7,909,673 | B2 | * | 3/2011 | Ivanic et al. | 446/15 |
| 7,922,039 | B2 | | 4/2011 | Jablonski et al. | |
| 2002/0132557 | A1 | | 9/2002 | Yu | |
| 2005/0148276 | A1 | * | 7/2005 | LaFata et al. | 446/18 |
| 2006/0163278 | A1 | | 7/2006 | Yeung | |
| 2009/0124161 | A1 | * | 5/2009 | Barish | 446/15 |
| 2009/0142986 | A1 | * | 6/2009 | San | 446/15 |
| 2012/0270462 | A1 | | 10/2012 | Lo | |

* cited by examiner

*Primary Examiner* — Kurt Fernstrom
(74) *Attorney, Agent, or Firm* — Minder Law Group; Willy H. Wong

(57) ABSTRACT

A water and bubble toy includes a water projecting assembly and a bubble generating assembly. Water is stored in a water reservoir located in a rear handle of the toy while bubble solution is stored in a detachable reservoir. The water generating assembly is operated by a lever located toward an upper end of the toy. When the lever is pulled, the lever activates a first pump that expels water from the toy. The bubble generating assembly is operated by a finger trigger that activates an electric motor, which powers a second pump and a fan. The second pump pumps bubble solution to a ring and the bubble solution coats the ring. The fan blows air through the ring and helps generate and propel bubbles from the ring.

2 Claims, 4 Drawing Sheets

WATER AND BUBBLE TOY

BACKGROUND OF THE INVENTION

1. Field of Invention

This invention relates to toys. In particular, this invention relates to a toy that projects water and generates bubbles.

2. Description of the Prior Art

Toys that expel water and/or bubbles are known in the art. Several popular versions of these toys are styled as guns and pistols, most often with finger triggers activating the water squirting and bubble generating mechanisms. Another version activates these mechanisms using a pump-action structure similar to the pump-action handgrips used in shotguns. Such toys have several drawbacks, especially when these toys are used by small children, who have limited strength and reach. Due to their limited physical capabilities, small children have difficulty operating the actuators and are only able to apply limited force onto the actuators. Without adequate force pushing against the actuator, the traditional water guns project less water and project the water to shorter distances.

In an attempt to improve upon these traditional water guns, inventors developed pressure activated water toys that built up pressure in a reservoir prior to projecting water. The pressurization mechanisms added several moving parts, thus adding to cost and increasing product failure rates of the toys. More critically, the pressurization mechanisms constituted safety hazards. Water and bubble toys are typically made of plastics or other inexpensive materials. Such materials have low tensile strengths and are not suited to hold pressurized fluids.

Water and bubble toys with multiple actuators are also known in the art. Like the toys mentioned above, these water and bubble toys feature multiple drawbacks, particularly when operated by small children. For example, some water toys utilize two finger triggers. Because small children's fingers are not very nimble, small children sometimes have difficulty operating a single finger trigger. Having two finger triggers in close proximity to each other further complicates the operation of these finger triggers.

SUMMARY OF THE INVENTION

Accordingly, it is an object of the invention to address the aforementioned problems in the prior art.

It is another object of the invention to provide an actuator that users can easily operate.

It is a further object of the invention to generate increased pressure in a fluid reservoir without having to add moving parts associated with typical pressurization mechanisms.

It is a further object of the invention to increase pressure in a fluid reservoir in a safe manner.

It is a further object of the invention to maximize stability when a user is holding and operating the toy.

It is a further object of the invention to provide a compact toy capable of expelling fluids from multiple reservoirs.

According to one embodiment of the present invention, these and other objects are attained by a toy having a reservoir capable of holding fluids. The reservoir can be set in the rear handle of the toy. The fluid is expelled from the toy by a pump, which is operated by lever positioned toward the top of the toy. In this embodiment, the lever and the pump are separate structures and the lever activates the pump when the lever pulled towards the user. However, it will be understood by those skilled in the art that these are merely exemplary components, and that the present invention is by no means limited to any particular implementation or combination of such components. For example, other implementations can use a structure that combines both the pump and the lever. In addition, other embodiments can utilize levers that operate when the lever is moved in a direction or directions other than in the direction of the user. Similarly, the reservoir can be designed to be positioned in other parts of the toy and can be designed to be detachable.

Another embodiment of the invention provides a second reservoir also capable of holding fluid. The fluid in the second reservoir is pumped by an electric motor activated by a finger trigger. The invention can utilize non-electrical pumps as well. In embodiments that generate bubbles, bubble solution stored in the second reservoir is pumped to a ring and the bubble solution coats the ring. A fan blows air through the ring and helps generate and propel bubbles from the ring. The toy also has a wiper adjacent to the ring that moves along a surface of the ring. In alternative embodiments, a movable ring can move along a stationary or a movable wiper to achieve the same wiping effect. The moveable structure, whether it be the wiper or the ring, can be actuated by the finger trigger. Depending on the embodiment, the finger trigger can directly move the structure, or the finger trigger can move the structure indirectly by activating an electric motor that in turn moves the structure.

The invention is further described with reference to the following drawings.

DETAILED DESCRIPTION OF THE INVENTION

Figure 1:
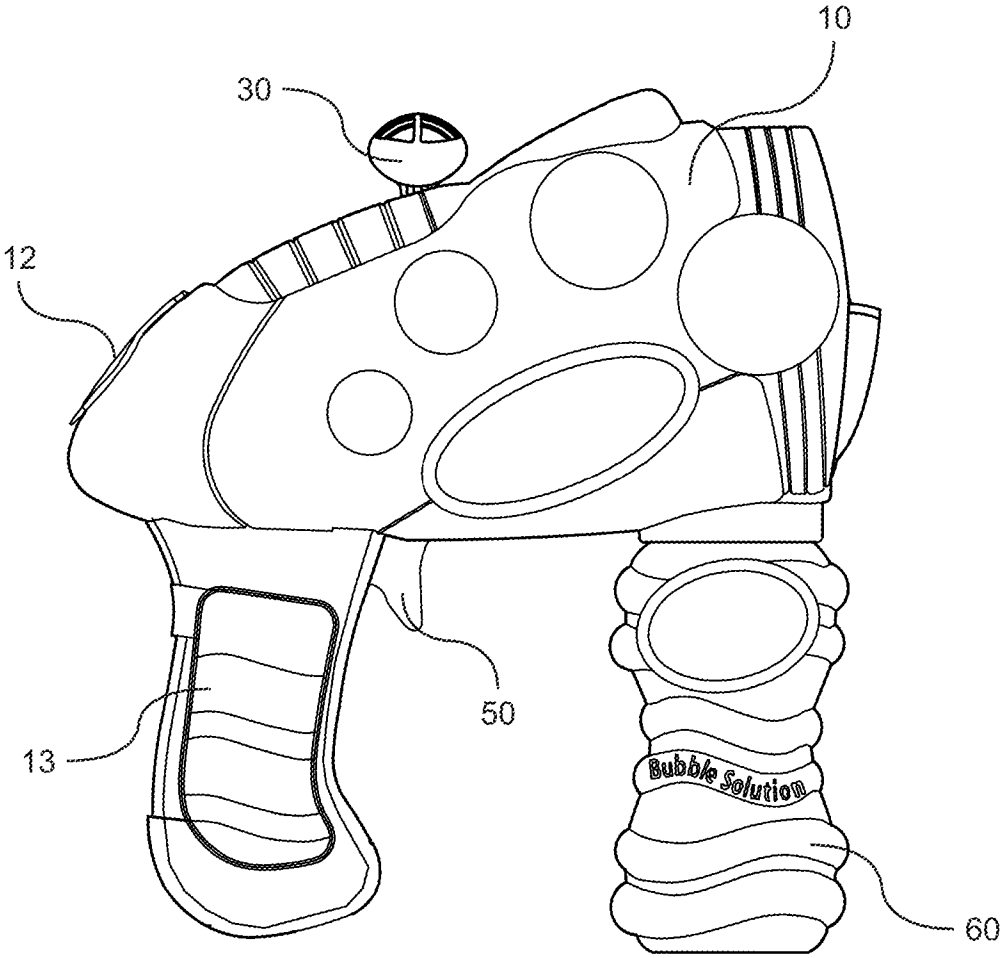
FIG. 1 is a side view illustrating a first preferred embodiment of the present invention.

Referring to the drawings, a description will be made with regards to preferred embodiments of a water and bubble toy according to the present invention.

FIG. 1 shows a first preferred embodiment of the present invention. A housing 10 with a rear handle 13 encloses a water projecting assembly and a bubble generating assembly. The water projecting assembly is actuated by a lever 30 located toward an upper surface of the toy and the bubble generating assembly is actuated by a finger trigger 50 located toward a lower surface of the toy. Water used for the water projecting assembly can be poured into an opening covered by a cap 12. Bubble solution used in the bubble generating assembly can be provided in the detachable reservoir 60.

Figure 2:
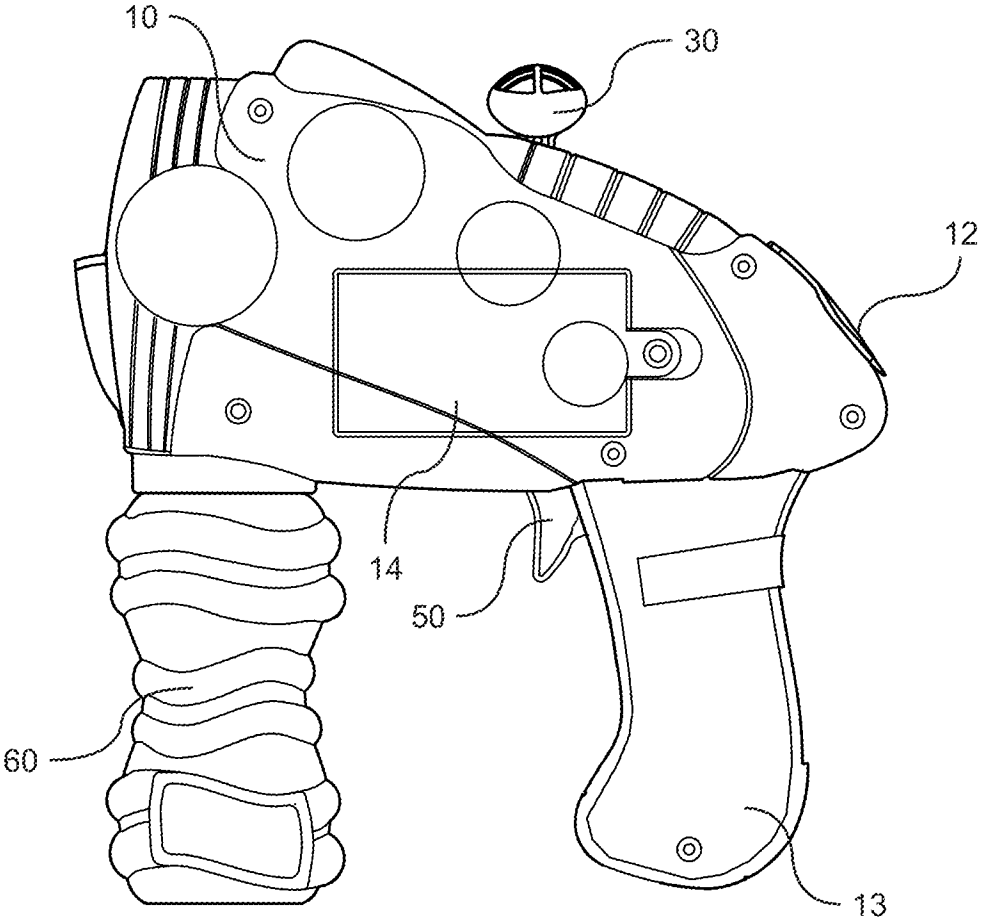
FIG. 2 is another side view of the present invention.

FIG. 2 shows a battery compartment cover 14 of the present invention. The battery compartment cover 14 encloses batteries and a battery compartment (not shown).

Figure 3:
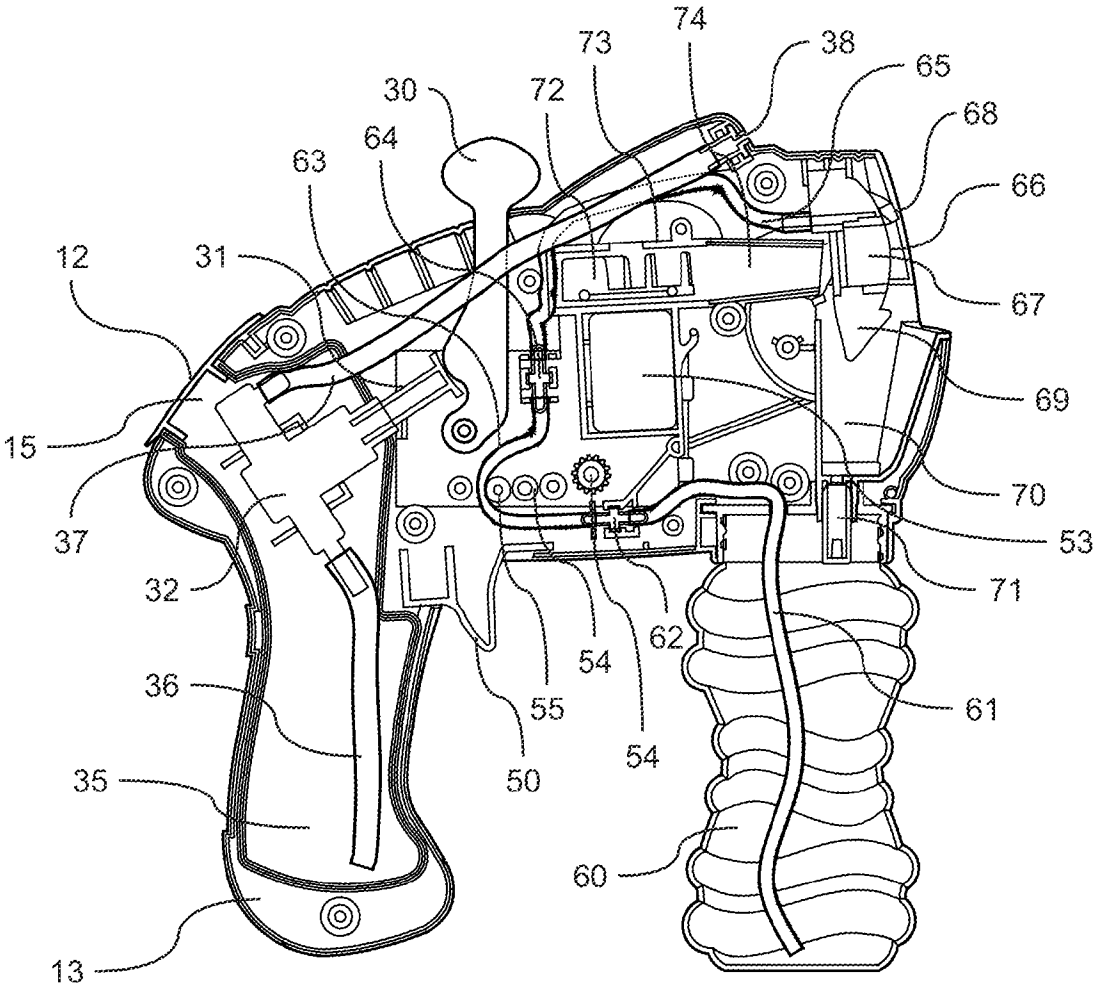
FIG. 3 is a sectional side view of the present invention.
Figure 4:
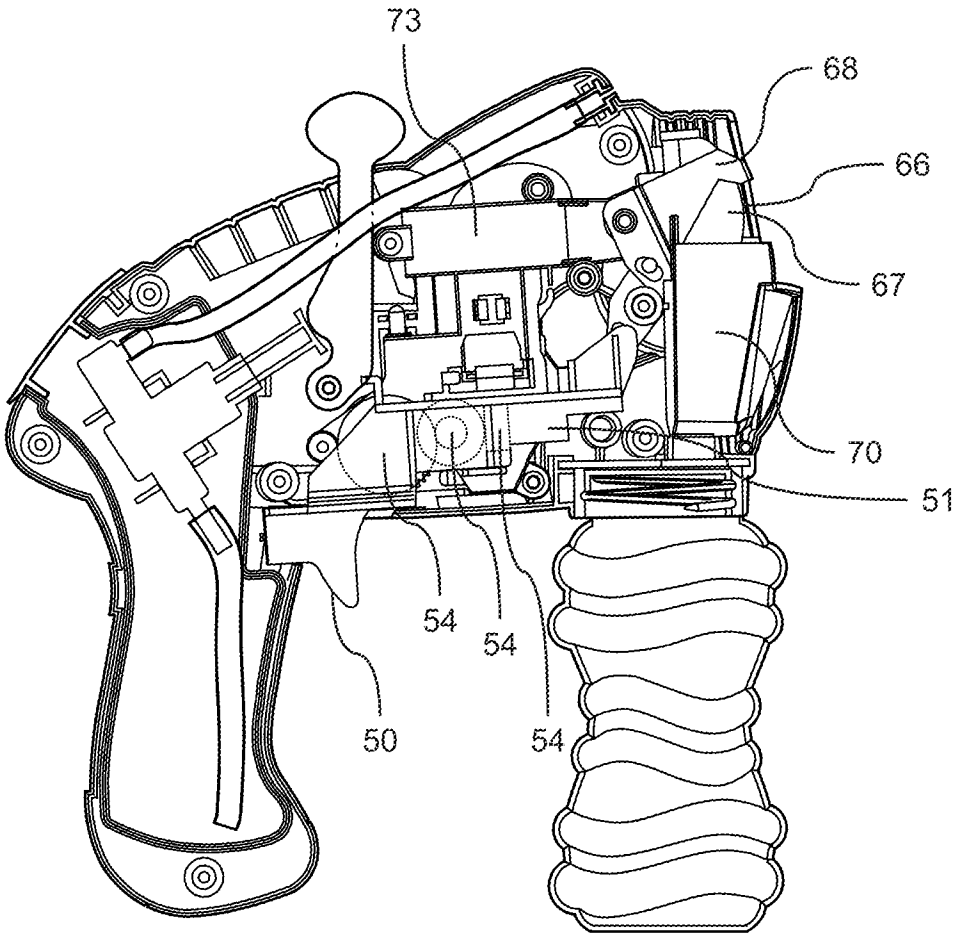
FIG. 4 is a side view of the present invention with a portion of the housing removed.

As illustrated in FIGS. 3 and 4, when the cap 12 is open, water for the water projection assembly can be a poured through the opening 15 into a water reservoir 35 located in the rear handle 13. The water projecting assembly is actuated by the lever 30. As a user pulls back the lever 30, the lever 30 pushes against a lever trigger 31 to activate a water pump 32. The water pump 32 pumps water stored in the water reservoir 35 from a lower water tube 36 to an upper water tube 37, where the water exits the toy through a nozzle 38.

In one form of the invention, there is a second actuator for activating the bubble generating assembly. The finger trigger 50 is pulled back toward the rear handle 13. This puts a contact plate (not shown) in contact with a motor 53, thereby completing a circuit to power the motor 53. A lower motor rod of the motor 53 turns gears 54. The gears 54 turn a roller 55, which pumps the bubble solution stored in the detachable reservoir 60 through a lower solution tube 61, a lower tube connector 62, a middle solution tube 63, an upper tube connector 64, and an upper solution tube 65 to a bubble ring 66 supported by a ring stay 67. The bubble solution coats the bubble ring 66 and creates a film on the bubble ring 66.

An upper motor rod of the motor 53 powers an air generator such as a fan 72 located inside a fan housing 73. Air generated by the fan 72 blows through a vent 74. The vent 74 directs the air toward the bubble ring 66. As the air blows through the bubble ring 66, the air interacts with the film to form bubbles.

Excess bubble solution is wiped from the surface of the bubble ring 66 by a wiper 68. The wiper 68 is connected to the finger trigger 50 via a finger trigger arm 51 and the wiping motion executes as the finger trigger 50 moves back and forth between an on position and an off position. Excess bubble solution then slides downward to a triangular plate 69 and drips into a return reservoir 70. Excess bubble solution gathered in the return reservoir 70 flows through a return tube 71 and back into the detachable reservoir 60, where it can be reused by the bubble generating assembly. A ball bearing (not shown) can be placed in the return tube 71 to prevent backflow when the toy is tilted.

While the above preferred embodiments utilize exemplary components to illustrate the mechanisms of the present invention, those skilled in the art will be able to appreciate that other implementations can be used as alternatives to the components. For example, while the preferred embodiments described above use the movable wiper 68 with the stationary bubble ring 66, the same wiping action can be achieved using a stationary wiper with a movable bubble ring, or using wipers and bubble rings that are both movable.

Similarly, the aforementioned preferred embodiments describe the water projecting assembly and the bubble generating assembly as independent systems, but other embodiments of the invention provide for interaction between the different systems. For example, in another preferred embodiment, the user can simultaneously activate both the water projecting assembly and the bubble generating assembly using the lever 30.

While the foregoing is a description of the preferred embodiments carried out by the invention, it will be understood that the invention is not limited to the particular embodiments shown and described herein, but that various changes and modifications may be made without departing from the scope or spirit of this invention as defined by the following claims.

LIST OF REFERENCE NUMBERS

10 housing
12 cap
13 rear handle
14 battery compartment cover
15 opening
30 lever
31 lever trigger
32 water pump
35 water reservoir
36 lower water tube
37 upper water tube
38 nozzle
50 finger trigger
51 finger trigger arm
53 motor
54 gears
55 roller
60 detachable reservoir
61 lower solution tube
62 lower tube connector
63 middle solution tube
64 upper tube connector
65 upper solution tube
66 ring
67 ring stay
68 wiper
69 triangular plate
70 return reservoir
71 return tube
72 fan
73 fan housing
74 vent

What is claimed is:

1. A toy, comprising:
a housing having an upper end and a lower end;
a first pump;
a first reservoir capable of containing fluid;
a handle located on the lower end of the housing;
a lever, located on the upper end of the housing, that is capable of engaging the first pump;
a distal end of the lever;
a first lever position;
a second lever position;
a second reservoir capable of containing fluid;
a second pump;
a finger trigger, located adjacent to the handle, that is capable of engaging the second pump;
a fan;
a motor;
a bubble ring;
a wiper capable of moving along a surface of the bubble ring;
a triangular plate located below the bubble ring;
a return reservoir located below the triangular plate; and
a return tube with a ball bearing;
wherein when the lever engages the first pump, fluid from the first reservoir is expelled outside of the housing;
wherein the distal end of the lever is directly above the handle when the lever is in a position between the first lever position and the second lever position;
wherein when the finger trigger engages the second pump, fluid from the second reservoir is pumped toward the upper end of the housing;
wherein the finger trigger can be in an on position and in an off position;
wherein when the finger trigger is in the on position, the motor powers the second pump and the fan, the powered second pump pumps fluid from the second reservoir to a spot above the bubble ring, and the powered fan generates air that can be directed toward the bubble ring; and
wherein the wiper is capable of removing excess fluid from the surface of the bubble ring, some of the excess fluid runs down from the bubble ring to the triangular plate before entering the return reservoir, some of the excess fluid in the return reservoir returns into the second reservoir through the return tube, with the ball bearing capable of preventing the fluid in the second reservoir from entering the return reservoir through the return tube.

2. A toy, comprising:
a housing having an upper end and a lower end;
a first pump;

a first reservoir capable of containing fluid;
a handle located on the lower end of the housing;
a lever, located on the upper end of the housing, that is capable of engaging the first pump;
a distal end of the lever;
a first lever position;
a second lever position;
a second reservoir capable of containing fluid;
a second pump;
a finger trigger, located adjacent to the handle, that is capable of engaging the second pump;
a fan;
a motor;
a bubble ring;
a wiper capable of moving along a surface of the bubble ring;
a triangular plate located below the bubble ring;
a return reservoir located below the triangular plate; and
a return tube with a ball bearing;
wherein when the lever engages the first pump, fluid from the first reservoir is expelled outside of the housing;
wherein the distal end of the lever is directly above the finger trigger when the lever is in a position between the first lever position and the second lever position, and wherein when the finger trigger engages the second pump, fluid from the second reservoir is pumped toward the upper end of the housing;
wherein the finger trigger can be in an on position and in an off position;
wherein when the finger trigger is in the on position, the motor powers the second pump and the fan, the powered second pump pumps fluid from the second reservoir to a spot above the bubble ring, and the powered fan generates air that can be directed toward the bubble ring; and
wherein the wiper is capable of removing excess fluid from the surface of the bubble ring, some of the excess fluid runs down from the bubble ring to the triangular plate before entering the return reservoir, some of the excess fluid in the return reservoir returns into the second reservoir through the return tube, with the ball bearing capable of preventing the fluid in the second reservoir from entering the return reservoir through the return tube.

* * * * *